US005853506A

United States Patent [19]

Meldrum

[11] Patent Number: 5,853,506

[45] Date of Patent: Dec. 29, 1998

[54] METHOD OF TREATING METAL WORKING DIES

[75] Inventor: Fritz Meldrum, Bedford, Ind.

[73] Assignee: Ford Motor Company, Dearborn, Mich.

[21] Appl. No.: 888,593

[22] Filed: Jul. 7, 1997

[51] Int. Cl.[6] ..... B23P 15/24

[52] U.S. Cl. ..... 148/514; 76/107.1; 427/435

[58] Field of Search ..... 419/5, 27; 427/435; 148/514

[56] References Cited

U.S. PATENT DOCUMENTS

| | | | |
|---|---|---|---|
| 3,804,600 | 4/1974 | Holman | 419/5 |
| 3,811,961 | 5/1974 | Weinstein et al. | 428/548 |
| 3,873,478 | 3/1975 | Parkinson | 428/323 |
| 3,883,314 | 5/1975 | Schnyder et al. | 419/27 |
| 3,900,940 | 8/1975 | Gebhard | 419/27 |
| 4,105,443 | 8/1978 | Dearnaley et al. | 75/238 |
| 4,204,031 | 5/1980 | Takemura et al. | 427/435 |
| 5,292,022 | 3/1994 | Blanco | 220/257 |
| 5,368,757 | 11/1994 | King | 72/42 |

FOREIGN PATENT DOCUMENTS 4-293998 10/1992 Japan .

*Primary Examiner*—George Wyszomierski
*Attorney, Agent, or Firm*—Joseph W. Malleck

[57] ABSTRACT

A method of treating metal working dies by the steps of: forming a metal working die part to be constituted of consolidated particulate material with a porosity in the range of 0.01–0.5%; immersing the part in a lubricant that is flowable under the working conditions of use for the die part, the lubricant being contained within a pressure chamber; raising the pressure within the chamber to 3,500 psi and the temperature of the lubricant to about 100° C. for a period of time sufficient to allow the lubricant to migrate and be trapped within the micro pores of the part with a positive internal pressure; and placing into use the treated cold working die part so that such die part is subjected to shear, such use being without the need for burn in and redressing.

6 Claims, 2 Drawing Sheets

METHOD OF TREATING METAL WORKING DIES

BACKGROUND OF THE INVENTION

1. Technical Field

This invention relates to the technology of enhancing the working life of cold working die surfaces, and more particularly to reducing or eliminating the need to redress cold working die surfaces constituted of integrated particles.

2. Discussion of the Prior Art

Cold working of metal work pieces takes many forms, but essentially comprises plastically deforming the workpiece under great pressure as it is forced against the die surface, typically cylindrical cavity. Such cold working at the very least involves slipping and sliding between the die and work piece surfaces. This is exemplified when making a product such as stainless steel tubing with a contoured neck and nipple thereon designed to receive adjoining hoses. The tubing must be reduced in diameter at an end and given an annular bead to contour such neck. Even large work pieces such as blocks or cylinders may be required to be changed in shape by cold working wherein the cold working attains a type of plowing or displacement of the work piece metal that goes beyond slipping and sliding between the die and work piece.

Regardless of the type of cold working involved, galling of the die surfaces can occur often as a result of the transfer of micro particles of the work piece to the die surface causing scratching or grooving in subsequent work pieces prepared with the same die. Die lubricants are usually applied to the exterior of the die working surfaces, but during repeated cold working, such lubricants may be absent at one or more locations, allowing galling (or a form of microwelding) to occur. Suppliers of carbide or other powder metal extrusion and cold working dies often recommend that their dies be broken in by what is known as a burn-end and redressing sequence to reduce the effect of galling. This involves repeated actual use of the cold working die with actual work pieces, which are usually discarded, so as to prompt or initiate early galling which upon redressing is reduced or eliminated temporarily. This sequence is time consuming and adversely affects the manufacturing cycle time.

Such cold working dies are constituted of sintered powder particles selected from carbides or metal alloys that have high hardness and resistance to wear when used to define die surfaces in cold working dies. To increase the working life of such die surfaces, implantation of ions of a wide variety of materials has been suggested (see U.S. Pat. No. 4,105,443). Such ions can involve alkaline metal or sulfide formers (Li, Na, Mg, K, Ca, Ti, V, Mo W, Bi), or metals that form soft oxides (Fe, Cu, Zn, Mo, Ag, Cd, In, Sn, Pd) or even elements that form non-metallic compounds (B, B, O, Cl, He, Co, Br, Be). The object of such ion implantation is to prevent the interaction between the matrix metal of the die and the metal being worked upon. Such technique of ion implantation has not been totally accepted because it is not universally compatible with die materials and often produces inconsistent or uneconomic results. It is also known in the prior art to adherently add a boridized layer to the working die surface or to weld a lead or copper layer to the exterior of the working die surface to act as a smearable solid lubricant (see U.S. Pat. No. 3,811,961). In each case, such adhering layers have not proved entirely successful for purposes of cold working dies because adhesive does not attain a true molecular bond and often causes random areas of separation which result in impredicatable failure during the forming process.

SUMMARY OF THE INVENTION

It is an object of this invention to provide a method for economically enhancing the functional life of cold working dies while at the same time significantly reducing the down time for a machine using the cold working dies.

The invention herein that meets the above object comprises a method of treating metal working dies by the steps of: (a) forming a metal working die part to be constituted of consolidated particulate material with a porosity in the range of 0.01–0.5%; (b) immersing the part in a lubricant that is flowable under the working conditions of use for the die part, the lubricant being contained within a pressure chamber; (c) raising the pressure within the chamber to 3,500 psi and the temperature of the lubricant to about 100° C. for a period of time sufficient to allow the lubricant to migrate and be trapped within the micro pores of the part with a positive internal pressure; and (d) placing into use the treated cold working die part so that such die part is subjected to shear, such use being without the need for burn in and redressing.

DETAILED DESCRIPTION AND BEST MODE

Figure 1:
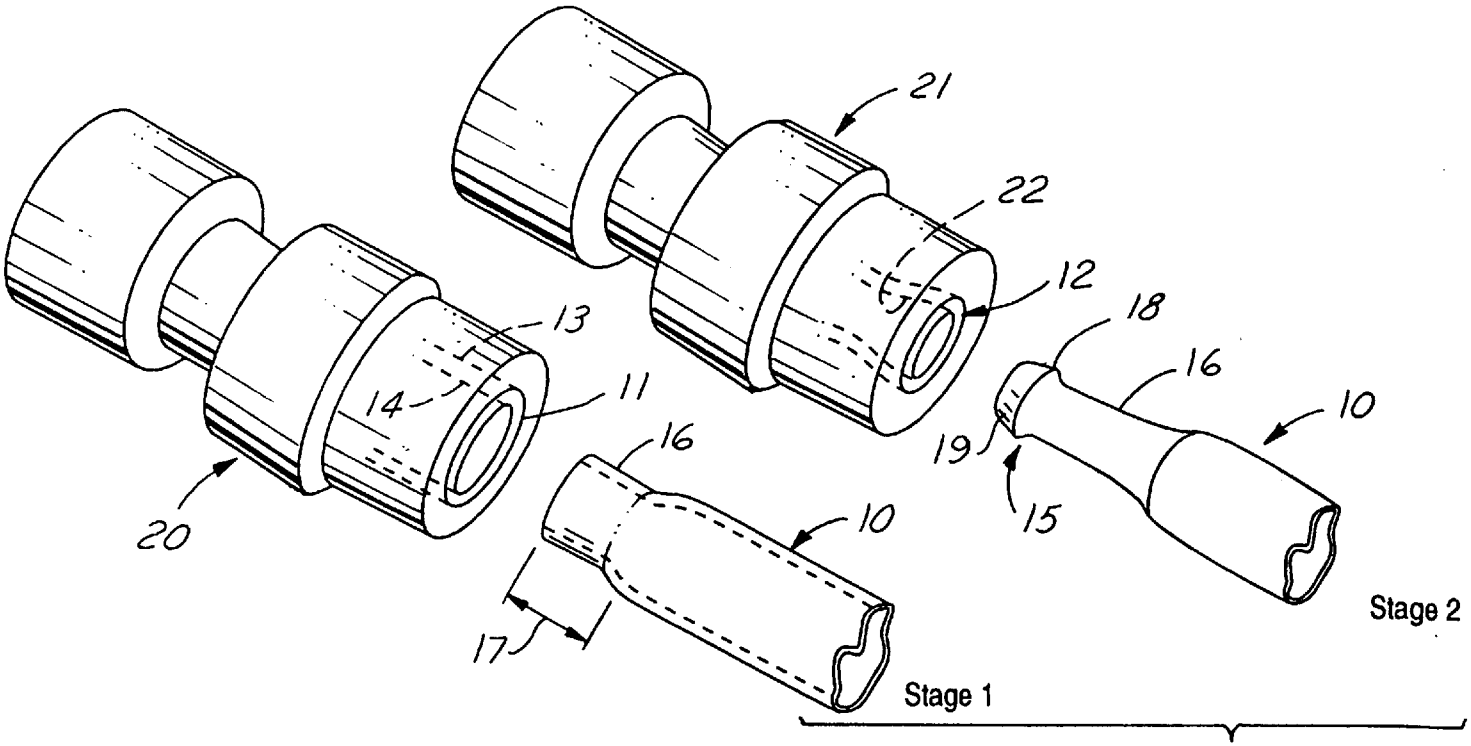
FIG. 1 is a composite of cold working tools shown in perspective, the tools being used to sweg the ends of tubing in two stages, the cold working surfaces of such tools being treated in conformity with this invention.

Cold working dies are desirably formed of particulate material such as sintered alloys, ceramics, carbidic or metallic powder; such dies are carried and supported in steel housings or tools to enhance mechanical properties by compressive support. Cold working dies 11, 12, shown in FIG. 1, are formed by known powder consolidating techniques wherein the metal or metal carbide powder supply is subjected to heat and pressure to form a shape (i.e. sleeve 13) having the desired working surfaces 14 for deforming a workpiece 10.

The work piece 10 undergoing cold working can be any type of reworkable metal or alloy that plastically deforms under pressure or may be extruded. For example (as shown in FIG. 1), to create a shaped end 15 for stainless steel tubing (as the workpiece) to facilitate connecting the end of the tubing to another element or hose, the tubing must be reduced in diameter along a specific length 17 at such end to form a neck (stage 1) and then crimped to form an annular bead 18 about the terminal portion 19 of the neck (stage 2). A first tool 20 thus must be formed with an inner powder carbide sleeve that constitutes the die 11; the die has an inner cylindrical working surface 14 sized to create the desired reduction in diameter of the exterior of the stainless tubing (from ⅜ inch diameter to about 5/16 inch diameter). The stock of tubing is forced into the die with a pressure of about 24,000 lbs., sufficient to plastically reduce the tubing wall along the length 17. Another carbide powder sleeve is shown for stage 2; the die is carried in tool 21 and die 12 has a working surface 22 shaped to form the annular bead 18; it again is formed when the reduced neck of the tubing is forced there against.

The die working surfaces must have a tight metallurgical structure that doesn't shear under extrusion or severe sliding friction. Carbidic metal powder for use in forming the cold working surfaces of the tool of this invention may be titanium carbide, silicon carbide, tantalum carbide, and others. Other materials for forming the cold working tool may comprise ceramic or other metal alloy particulates. For purposes of this invention, the die working surfaces 14 and 22 should advantageously have a porosity in the range of 0.01–0.5%. Such porosity is obtained in powder consolidated dies. Wrought metal, which normally is through to be non-porous, after having been reworked to form load bearing surfaces, may also contain ultra small micro porosity beneath the working surface (sometimes less than 0.05%) which can create labyrinth in which a flowable lubricant can become entrapped to create a positive internal pressure (i.e. of about 0.01–1.0 psi)and thus benefit from this invention.

As indicated earlier, conventional die working surfaces experience a galling effect after a number of cold working cycles when deforming metal workpieces, such as steel, aluminum or multi alloy materials. Galling will occur when working stainless steel, at least at about 10,000 cycles or less for the type of tools shown in FIG. 1. Very small particles of stainless steel tubing may transfer to the working surface of the die and become micro welded thereto so that upon a subsequent working cycle, the die surface will scratch or abrade the next stainless tubing undergoing working. As the die continues to be repeatedly used, imperfections in the tubing undergoing working may become exaggerated and significant galling will occur to the point where the die must be redressed. Each time the die is redressed, there may be slight dimensional modifications of the die surface diameter such that repeated dressing may result in out of tolerance work pieces. Not only should such out of tolerance work pieces be avoided but any scratching or imperfections in the surface of the work pieces should also be avoided. This invention can eliminate or substantially reduce such galling and the need for redressing.

Figure 2:
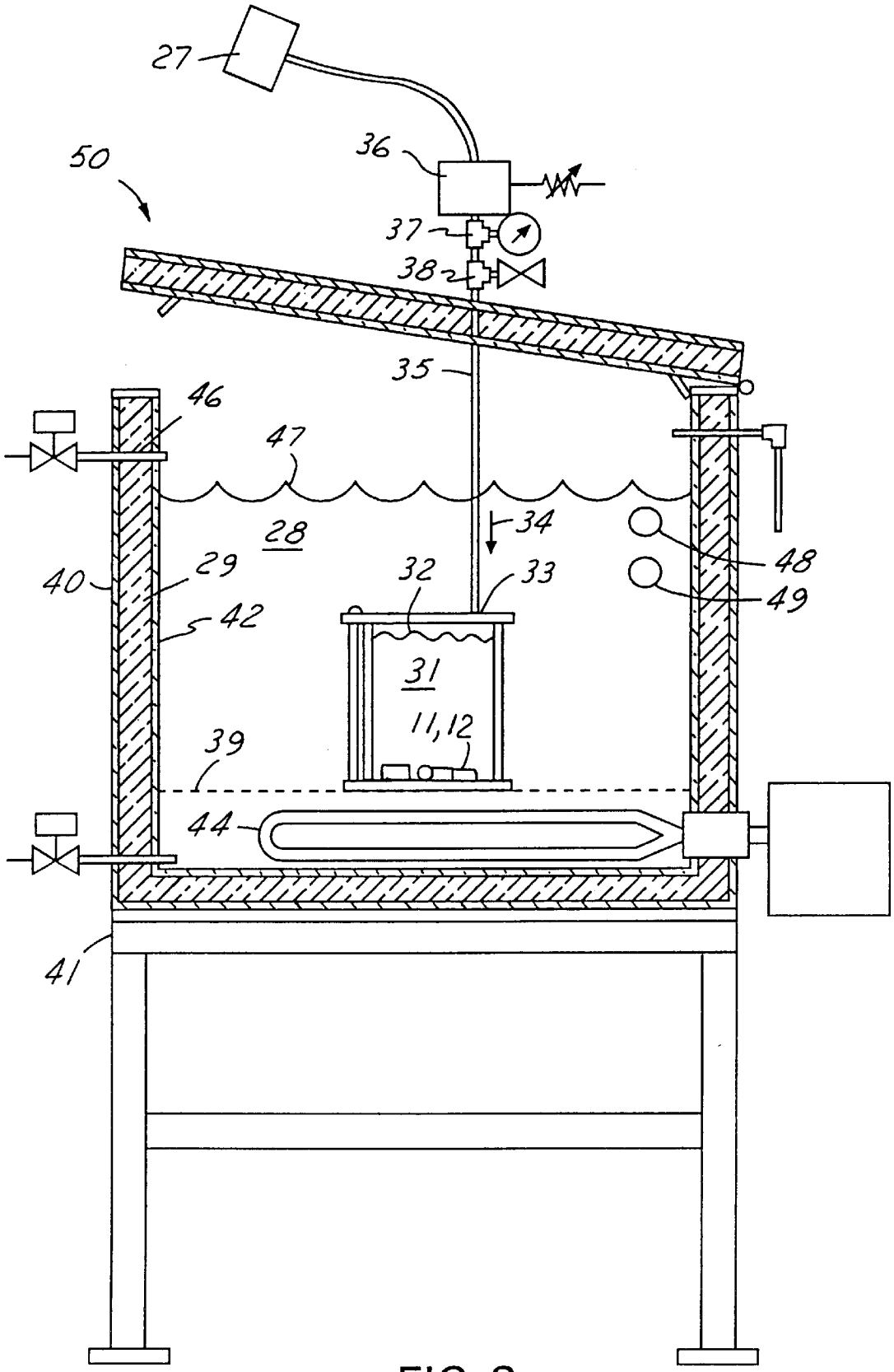
FIG. 2 is a cross-sectional elevational view of a representative apparatus for carrying out the impregnation portion of the method of this invention.

To this end the formed dies of FIG. 1, having working surfaces with a controlled sub-surface porosity of 0.01–0.5%, are subjected to an impregnation step wherein flowable lubricant is forced into such porosity under elevated pressure and temperature. As shown in FIG. 2, a pressure chamber 30 is adapted to contain several of the cold working tools 11,12 immersed in a liquid impregnating lubricant 31, such as chlorinated paraffin containing fatty esters, filling the chamber to a level 32. After the tools are inserted into the lubricant, the chamber 30 is sealed except for an inlet 33 thereto providing for the ability to introduce an inert or non-oxidizing gas 34, such as nitrogen, from a supply 27, through a line 35 to elevate the pressure within the chamber 30. Suitable controls for the gas are provided, such as a regulator fill valve 36, a pressure gage 37, and a manual pressurizing gas needle release valve 38.

The chamber is supported on a grate 39 within a larger insulated heating vessel 40 mounted on a base plate and table 41. Such vessel 40 is insulated at 29 and glass lined at 42 to hold water 28 that is heated by a heater element 44 disposed below the grate. The vessel and heating element can elevate the water temperature to a range of 100°–300° C. Water is filled into the vessel through an inlet 46 to a level 47 as controlled by float switches 48, 49. The vessel has a sealing-type insulated pivotal lid 50 to permit access to the interior as well as to permit sealing the interior. Once the tools with their cold working dies are sealed in the lubricant filled chamber 30 and the chamber is sealed in the water filled vessel 40, the tools are then heated to about 100° C. (i.e. 80°–120° C.) under a nitrogen gas pressure of about 1,000–3,500 psi. The lubricant is selected to be a chlorinated paraffin/ester which has a consistency or viscosity of thick honey at room temperature or equivalent to SAE 90 automotive oil. The temperature and pressure conditions are retained for about 90–100 hours. Other types of lubricants can be used, such as water soluble lubricants, petroleum based lubricants and synthetic or solvent based lubricants. The lubricant must be flowable under the pressure and temperature conditions of impregnation so as to fully migrate into the inner pores 51 and fill such pores with a positive pressure.

Figure 3:
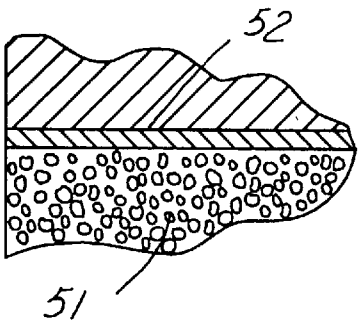
FIG. 3 is a highly enlarged schematic view of a portion of the cold working surfaces of the dies impregnated in accordance with this invention. The view illustrating the lubricate impregnated within the micro pores.

The cold working surfaces of such tools are thus soaked and impregnated with such lubricant; the lubricant is trapped in the pores or interstices 51 of the consolidated powder tool working surfaces with a positive interior pressure (as shown in FIG. 3). The selected lubricants can have a chemistry that not only promote such impregnation under such temperature and pressure parameters, but has an ambient temperature viscosity that allows for flow to the surface of the tool if the exterior film 52 of the lubricant is wiped or scratched away from the outer surface during use. The parameters of pressure, time and temperature can be adjusted to accommodate different types of lubricant. For example, a higher viscosity lubricant may require more time, higher temperature or pressure.

This invention not only extends the functional life of the dies but also reduces machine down time, reduces crib spare tools needed, improves surface finish of the worked material, and reduces the quantity of lubricants needed for bathing the cold working surfaces in processes such as swaging, crimping, cold forming and extrusion.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. A method of enhancing the working life of metal working dies, comprising:

(a) forming a metal working die part constituted of consolidated particulated material with micro pores providing a porosity in the range of 0.01–0.5%;

(b) immersing the part in a lubricant that is flowable under the working conditions of use for the die part, the lubricant being contained within a pressure chamber;

(c) raising the pressure within the chamber to about 1,000–3,500 psi, and the temperature of the lubricant to about 80°–120° C., for a period of time sufficient to allow the lubricant to migrate and be trapped within the micro pores of said part to create a positive internal pressure; and (d) placing the die part, impregnated with the lubricant into use for cold working that subjects a work piece to shear with no burn-in or redressing between placement of said lubricant in said micro pores and the use of said die part in said cold working use.

2. The method as in claim 1, in which during step (c), the lubricant is trapped within the interstices and pores of said part with a positive internal pressure of 0.01–1.0 psi, such that said lubricant is capable of replenishing the surface lubricant on the die part when such surface lubricant is forced away during step (d).

3. The method as in claim 1, in which said lubricant is selected from the group consisting of chlorinated paraffin and fatty esters, water soluble lubricants, petroleum based lubricants, and synthetic or solvent based lubricants.

4. The method as in claim 1, in which said die part, formed in step (a) has a tight molecular structure that does not shear upon the application of high sliding frictional forces there against.

5. The method as in claim 1, in which the particulated material for said die part is selected from the group consisting of carbide metal powders, high alloy steels, and sintered alloy or ceramic particulates.

6. The method as in claim 1, in which the work piece is comprised of a material selected from the group consisting of stainless steel, or reworkable metal that plastically deforms under high pressure.

* * * * *